United States Patent [19]

Lichtwardt

[11] Patent Number: 5,033,755

[45] Date of Patent: Jul. 23, 1991

[54] APPARATUS AND METHOD FOR A HAND BALL GAME

[76] Inventor: John R. Lichtwardt, 1860 Cragin Dr., Bloomfield Hills, Mich. 48013

[21] Appl. No.: 522,569

[22] Filed: May 14, 1990

[51] Int. Cl.[5] ..... A63B 71/00

[52] U.S. Cl. ..... 273/411; 108/153; 248/165; 248/172; 273/58 R; 273/342

[58] Field of Search ..... 273/411, 30, 29 BB, 273/309, 342; 248/165, 172, 97, 99, 231.8; 108/111, 153, 159, 137

[56] References Cited

U.S. PATENT DOCUMENTS

| | | | |
|---|---|---|---|
| 855,219 | 5/1907 | Anthony, Jr. | 248/172 X |
| 1,556,046 | 10/1925 | Taylor | 273/411 |
| 1,982,061 | 11/1934 | Marlowe | 248/165 X |
| 3,001,791 | 9/1961 | Atwood | 273/30 |
| 3,968,968 | 7/1976 | Peterson | 273/29 BB X |
| 3,990,663 | 11/1976 | Hendrickson et al. | 248/165 X |
| 4,340,222 | 7/1982 | Kerkenbush et al. | 273/DIG. 20 X |
| 4,357,019 | 11/1982 | Wouters | 273/411 |
| 4,444,171 | 4/1984 | Lohr | 273/402 |

*Primary Examiner*—William H. Grieb
*Attorney, Agent, or Firm*—David R. Syrowik

[57] ABSTRACT

A hand ball game includes a horizontal deck which extends between two standards. The lateral width of the deck is determined by the standards, while the longitudinal width of the deck separates the players. The deck is configured as an imperforate barrier to any ball seeking to fall through or penetrate the deck. The lateral width of the deck is adjustable as is the height of the deck, and the deck and standards knock down to a compact size for storage.

12 Claims, 3 Drawing Sheets

APPARATUS AND METHOD FOR A HAND BALL GAME

TECHNICAL FIELD

This invention relates to a hand ball game which includes a horizontal deck extending between two standards and a ball hit back and forth by the players.

BACKGROUND ART

Many games exist in which a ball is hit back and forth by the players across a barrier. Such games include tennis, badminton, and volleyball. A drawback to these games is that they require extensive playing space, and therefore are mainly played outdoors.

A few of these ball and barrier games are suitable for indoor play, for example Ping-Pong. A disadvantage of these indoor games is that they are not easily assembled and disassembled for storage or transportation. Furthermore, many of these games employ paddles or rackets. When used indoors, paddles and rackets often lead to the damage of household furnishings.

Several patents have addressed these problems. U.S. Pat. No. 4,357,019 to Wouters, issued Nov. 2, 1982, discloses a float ball apparatus suitable for indoor use. The apparatus utilizes a balloon type ball and two angularly displaced support rods which support the playing net. A drawback to this design is that it involves many parts, including the base, support rods, and the net.

U.S. Pat. No. 1,556,046 to Taylor, issued Oct. 6, 1925, discloses a game which uses an inflated ball batted across a tennis-type net. The playing space is surrounded on all sides by a net. An encompassing net such as this is cumbersome to set up and take down.

U.S. Pat. No. 3,968,968 to Peterson, issued Jul. 13, 1976, discloses a mini-volleyball court layout. The layout has weighted end posts which support a transversely extending net, and means to define the court boundaries. A problem with this device is that the use of a defined court area dictates that certain surfaces will be "in bounds", and others "out of bounds." Particularly when used indoors, this arrangement leads to disputes over whether shots land inside the defined court boundaries.

Inflatable balls for use in these games and others are also known. For instance, U.S. Pat. No. 4,340,222 issued Jul. 20, 1982 to Kerkenbush et al, discloses a game ball which incorporates an integrally molded plug in the interior of each hemisphere of the ball for providing means for introducing pressure into the ball. A drawback to this design is that the ball cannot be inflated without a special inflation needle.

DISCLOSURE OF THE INVENTION

I have invented a novel apparatus for playing a ball and barrier game indoors. My apparatus comprises two vertical standards which define the space between which the game ball must pass. The standards support a deck which is releasably attached to the standards such that upon release, the standards are biased laterally away from each other. The deck extends substantially from one standard to the other to further define the space between which the game ball must pass. The deck also defines a horizontal plane having a longitudinal dimension sufficient to separate the players, and is configured further as an imperforate barrier to any ball seeking to penetrate the deck.

Accordingly, it is an object of my invention to provide an improved game apparatus which may be positioned in a small area, for instance in a room of a house.

Another object of my invention is to design a game apparatus which can be easily set up and taken down so as to facilitate storage and/or transportation.

Another object of my invention is to design a game which can be played without damaging interior furnishings.

Still another object of my invention is to provide a game apparatus which does not require boundary lines to define the playing court.

Still another object of my invention is to provide a game apparatus which has standards which bias laterally away from each other upon a predetermined impact with the deck of the game apparatus.

Still another object of my invention is to provide a storage assembly for a hand ball apparatus which has planar standards held together in spaced apart upright position by a support member in a normal support position. For storage the assembly includes means for containing the planar standards in a side-by-side stacked relationship. The support member is removable from its normal position in the assembly and connectable to one of the standards within the plane of the standard when it is in the stacked relationship.

A specific object of my invention is also to provide a method of forming a ball by assembling an inflatable device which has an opening, a valve assembly, and a preformed valve ring. The method includes the steps of inflating the inflatable device, securing the valve ring around the opening of the inflatable device while inflated, deflating the inflatable device when the valve ring is secured thereto, and attaching the valve assembly to the valve ring.

Another specific object of my invention is to provide an improved method of forming a ball which may be inflated without specially designed tools.

A still more specific object of my invention is to provide an inflatable ball which includes a ball skin having a ball opening, a valve ring which is secured to the ball skin around the ball opening and which has a seat, and a valve assembly insertable through the valve ring into the ball. The valve assembly includes a sleeve having a shoulder connected to the seat when the valve assembly is inserted into the ball, and a hollow valve stem which is insertable through the sleeve and has a closed end, an open end, and a valve opening between the ends. The valve stem is slidably movable with respect to the sleeve between a first position with the closed end against the shoulder to block communication between the inside of the ball and the outside of the ball, and a second position with the closed end spaced from the shoulder sufficiently to expose the valve opening to the outside of the ball, whereby to place the inside of the ball in communication with the outside of the ball through the open end, the hollow of the valve stem, and the valve opening.

These and other objects, features and advantages of the present invention will be more apparent from the following description and drawings.

BEST MODE FOR CARRYING OUT THE INVENTION

Figure 1:
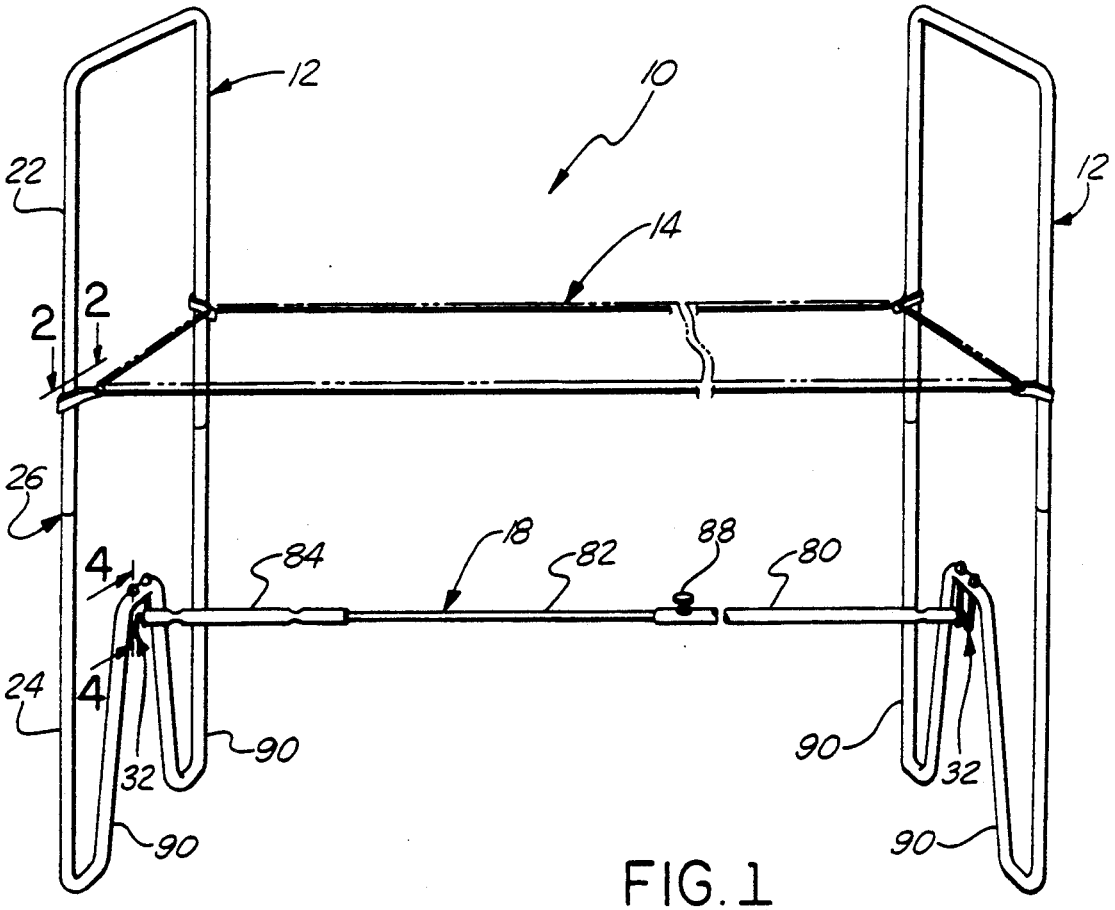
FIG. 1 is a perspective view of a hand ball game assembly in accordance with my invention.

With reference to the drawings, the preferred embodiment of the present invention will be described. Referring to FIG. 1, there is shown a hand ball game assembly 10. The game assembly generally comprises a pair of spaced apart standards 12 and a deck 14 extending between the standards 12. The deck 14 has a lateral dimension complementary to the distance between the standards 12, and a longitudinal dimension sufficient to separate the opposing players from each other. The deck 14 thus defines a generally horizontal plane, which may be any object or material capable of stopping the game ball from penetrating or passing through the plane. Preferably, this barrier is netting or a thin sheet of nylon material. It should be understood, however, that any surface imperforate to the game ball may be used.

The standards 12 extend above the deck 14 to a height sufficient to define a space through which the game ball must pass. Thus, the ball may travel between the standards 12 at an angle and land at a point outside the lateral width of the standards 12 and still be "in bounds." The standards 12 are preferably of two piece construction. The upper portion 22 of a standard 12 is adapted to telescopically engage the lower portion 24 of the standard 12 at a point 26 so that the height of the deck 14 may be increased or decreased, and also to facilitate disassembly of the standard 12 for packaging and storage.

The preferred embodiment of the game assembly 10 also includes a support member 18 which extends between the standards 12 below the deck 14. Preferably, the support member 18 and the standards 12 are constructed of hollow metal tubes.

Figure 2:
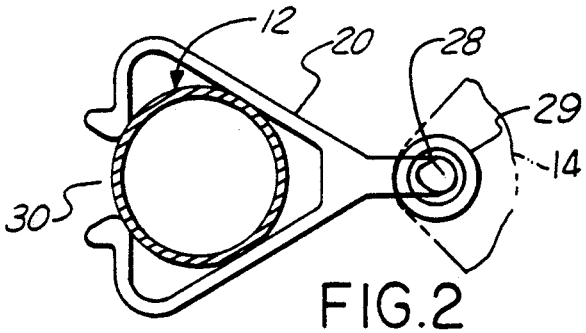
FIG. 2 is a sectional view partly in elevation and taken along line 2—2 in FIG. 1.

The game assembly 10 is designed such that upon a certain impact therewith, the deck 14 releases from standards 12, which then bias laterally away from each other. This is accomplished as follows. FIG. 2 shows how the corners of deck 14 are attached to standards 12 by clamps 20 which releasably connect the deck 14 to the standards 12. A hook 28 of a clamp 20 extends up through grommet 29 and thereby secures one corner of the deck 14 to a standard 12. When all four corners of the deck 14 are attached in this way, the deck 14 is pulled taut between the standards 12. Thus, the tension of the deck 14 keeps the standards 12 in an upright position, and prevents clamps 20 from slipping down the standards 12 due to gravity.

Furthermore, the clamps 20 are designed with an open end 30 so that they may be manually slid up or down the standards 12. This allows one to vary the height of the deck 14 above the floor. The open-end design of clamps 20 also permits the deck 14 to break away from standards upon any impact with the deck 14 above a predetermined load. Dislodgment of the deck 14 will cause the standards 12 to be biased outwardly by spring members 32, as described below. The clamps 20 and the spring member 32 may be made of metal, plastic, or any other material having flexible characteristics.

Figure 3:
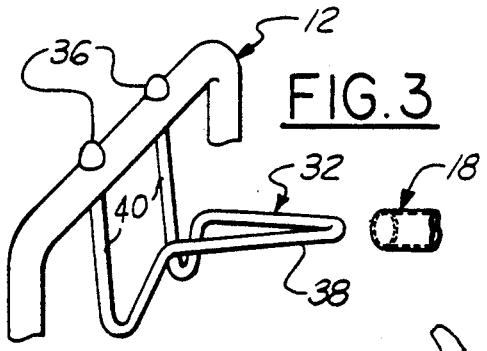
FIG. 3 is a fragmentary perspective view, partly exploded to show the relationship of a spring member in the assembly.
Figure 4:
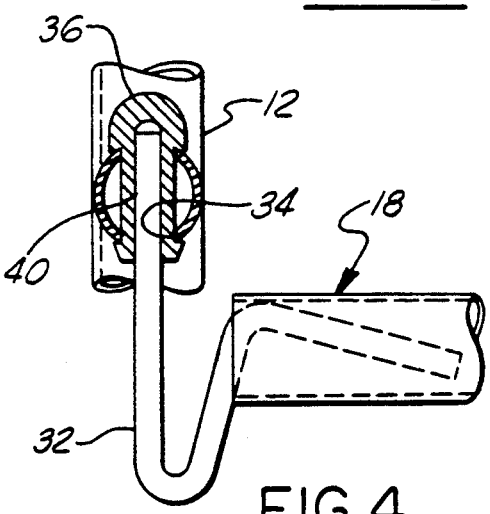
FIG. 4 is a sectional view of the spring member of FIG. 3 in a biased position with the deck of the assembly attached to the standards.
Figure 5:
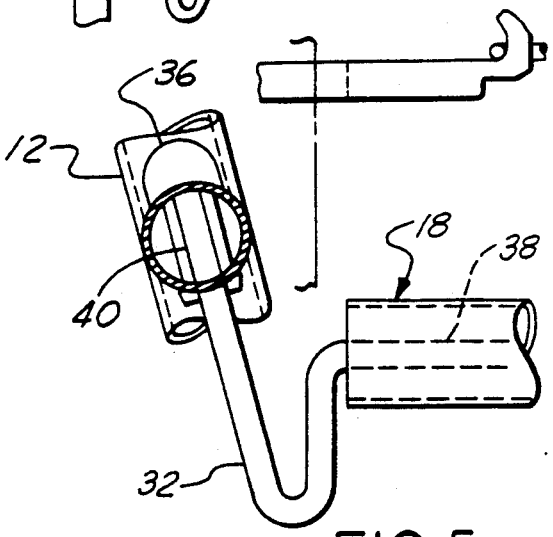
FIG. 5 is a view similar to FIG. 4 with the spring member in a bias released position.

FIGS. 3 through 5 show how standards 12 are biased outwardly upon release of the deck 14. Referring first to FIGS. 3 and 4, it can be seen how the ends 40 of spring member 32 are inserted through holes 34 in the standards 12. Plastic sleeves or cap nuts 36 are provided to releasably hold the spring members 32 in place, and also to cover the ends 40 of the spring member 32. The sleeves 36 also function to provide a cylinder through which the ends 40 of spring member 32 may travel through without damaging or wedging within the hollow tubing of standard 12. To complete the connection of the support member 18 to the standard 12, the closed-loop end 38 of spring member 32 is pinched and inserted into the open end of support member 18.

As shown in FIG. 4, each standard 12 extends at an approximately 90 degrees angle to the support member 18 when the deck 14 is in its attached and taut position for play. FIG. 5 shows that when the deck 14 is not attached to the standards 12, for example if the deck 14 has been dislodged, the standards 12 are forced or biased outwardly by the spring members 32 to an angle greater than 90 degrees to the support member 18.

Figure 6:
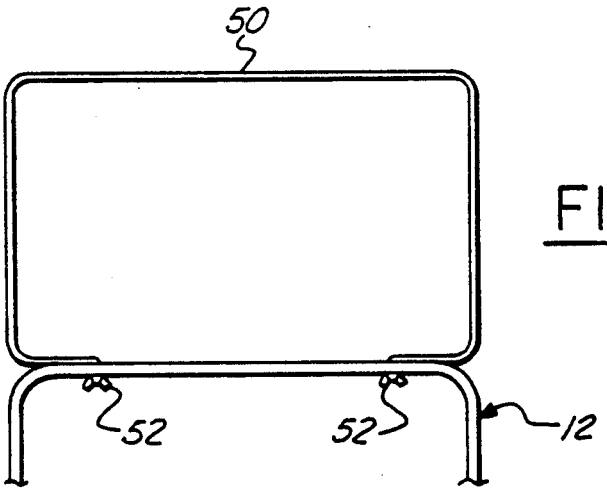
FIG. 6 is a fragmentary side elevational view of a standard of the assembly showing an optional extender member.

Referring now to FIG. 6, an extender member 50 ma be secured to the top of each standard 12 to increase the effective height of standards 12 above the deck 14. The extender members 50 are preferably solid metal tubes, and can be affixed to standards 12 by wing nuts 52 and bolts or by any other conventional means.

Figure 7:
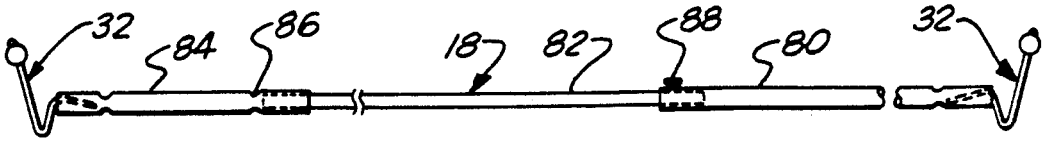
FIG. 7 is a side elevational view of a support member of the assembly, including optional spreader rods for extending the standards laterally.
Figure 8:
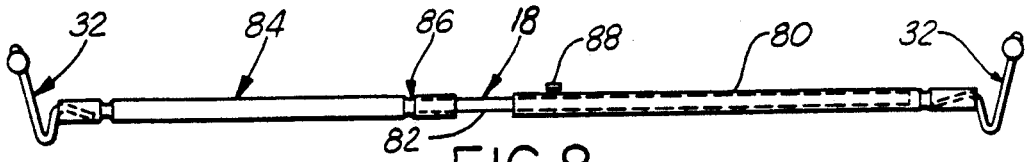
FIG. 8 is a view similar to FIG. 7 with one of the optional spreader rods unextended.

In order to allow the lateral distance between the standards 12 to be varied, the support member of the preferred embodiment comprises spreader rods 80 and 82, and a storage rod 84, as shown in FIG. 7. The storage rod 84, which is relatively shorter than spreader rods 80 and 82, is connected to one standard 12 by spring metal member 32 as described above. One spreader rod 80 is likewise connected to the opposite standard, and second spreader rod 82 is adapted to connect the storage rod 84 and spreader rod 80. One end of spreader rod 82 telescopically inserts to a predetermined stop 86 in storage rod 84, and the other end of spreader rod 82 telescopically slidably engages spreader rod 80. A screw 88 is provided to frictionally fix spreader rods 80 and 82 with respect to each other when the desired telescopic orientation or court width is reached. FIG. 8 shows one of the spreader rods 82 telescoped substantially within the other spreader rod 80, as might be done to configure a singles court suitable for two players.

Figure 10:
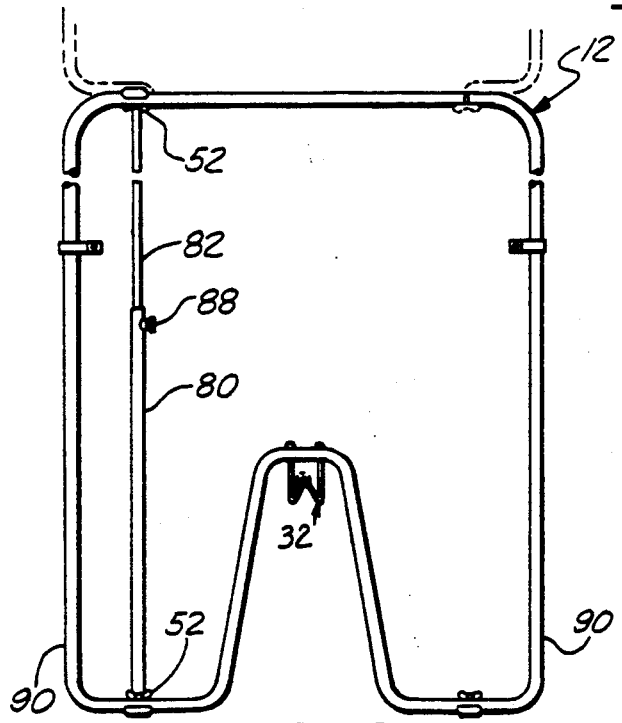
FIG. 10 is a side elevational view of a standard of the assembly in storage mode with two spreader rods connected to the standard in the plane thereof.
Figure 9:
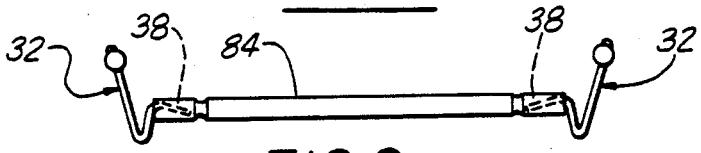
FIG. 9 is a side elevational view of the support member in storage mode with attached spring members.

FIGS. 9 and 10 show portions of the game assembly 10 being prepared for compact storage. As shown in FIG. 9, the spreader rods 80 and 82 are removed from their normal support position, and the closed-loop ends 38 of spring metal members 32 are inserted into the respective ends of storage rod 84. FIG. 10 shows the spreader rods 80 and 82 after removal from their support position and connected to a standard 12 within the plane thereof for storage. Preferably, the spreader rods 80 and 82 are telescopically extended so that their open ends fit around or over the upraised portions of wing nuts 52. Then screw 88 is tightened to hold the spreader rods 80 and 82 in place and at a length sufficient to secure them within the plane of standard 12.

Figure 11:
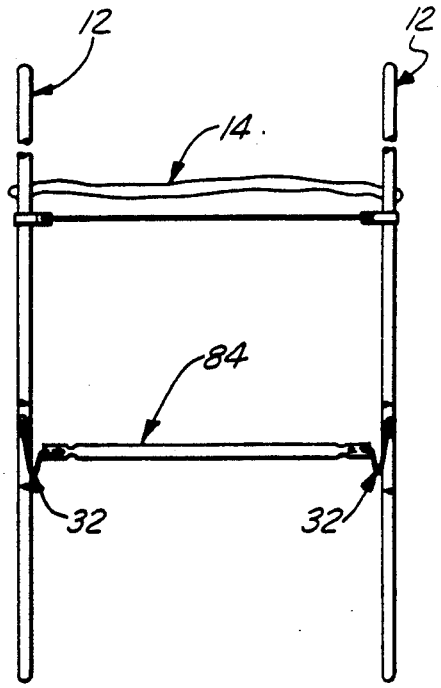
FIG. 11 is a front elevational view of the game assembly in storage mode.

FIG. 11 shows the storage assembly for the hand ball game apparatus after being compacted. The standards 12 are held together in spaced apart upright position by the storage rod 84 and deck 14, which is shown rolled or folded up. In this way, the standards 12 are contained in a closely adjacent side-by-side or stacked relationship, with the spreader rods 80 and 82 removed from their normal position and connected to one of the standards 12 as shown in FIG. 10. Thus, the game assembly 10 is easily and compactly stored with minimal disassembly.

Figure 12:
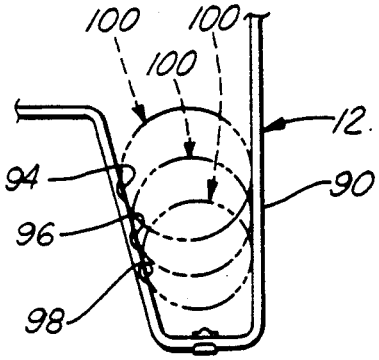
FIG. 12 is a fragmentary side elevational view of a leg portion of a standard of the assembly showing how the size of the game ball may be measured.

FIG. 12 shows how a leg portion 90 of a standard 12 can be used to measure the size of the game ball. Because a ball having a larger circumference or diameter encounters greater air resistance than a smaller ball, it will travel at a lower rate of speed. The ball may therefore be inflated to a desired size or circumference depending on the skill and/or number of players. This desirable result is achieved by forming the leg portion as a diverging or V-shaped segment of the standard. Indicia such as notches 94, 96, and 98 within the V-shaped segment may be used to indicate suggested inflations. For instance, an inflated ball which settles within leg portion 90 approximately to notch 94 may be suggested for use by beginners.

Figure 13:
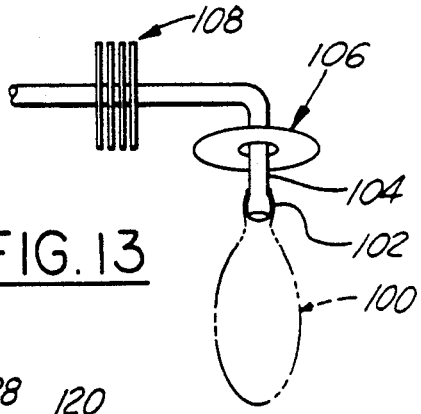
FIGS. 13 and 14 are schematic views and FIG. 15 a sectional view depicting sequential steps in the method of forming a game ball suitable for play with the hand ball game apparatus of this invention.
Figure 15:
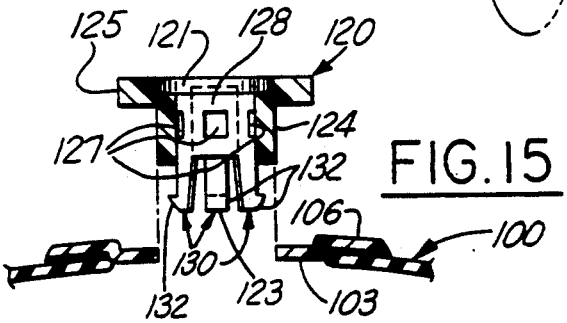
Figure 14:
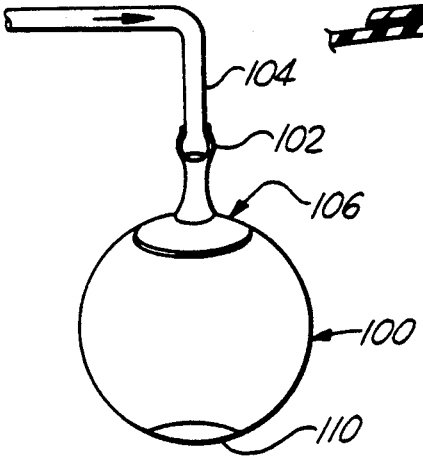
Figure 16:
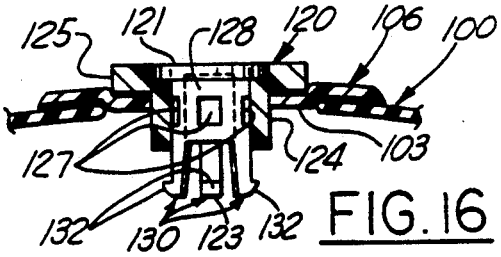
FIGS. 16 and 17 are sectional views of the valve of this invention in its closed and open positions, respectively.
Figure 17:
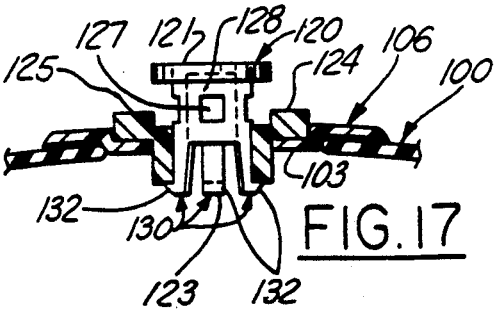

In FIGS. 13 through 15 there is shown a method of forming a ball from an inflatable device such as a balloon or other distensible material for use in this or other games.

FIG. 13 shows an inflatable device 100 with a neck portion 102 placed around the outlet nozzle 104 from a source of compressed gas. A valve ring 106 to be applied to device 100 is dropped from a reservoir 108 of valve rings for attachment to the inflatable device 100 upon inflation. The compressed gas is then released or supplied through nozzle 104, inflating the device 100 to a predetermined level of distension or size.

FIG. 14 shows the inflatable device 100 after it has been inflated to the predetermined level. Valve ring 106 is placed on the now inflated device 100, and is attached thereto, for example with rubber cement. Optionally, a counterweight 110 is cemented or otherwise attached to the inflatable device directly opposite valve ring 106 in order to evenly balance the added weight. After the valve ring 106 is securely attached, the neck portion 102 of inflatable device 100 is severed or shaved off at a location proximate a circular seat 103 in the valve ring 106. The device 100 will then be deflated, leaving an opening in valve ring 106 surrounded by the seat 103.

FIG. 15 shows how the valve assembly 120 is assembled and positioned in the game ball by insertion into valve ring 106. The valve assembly 120 comprises a sleeve 124 and a hollow valve stem 128 slidably received therein. The sleeve 124 has a circular shoulder 125. The valve stem has a closed end 121, an open end 123 and valve openings 127. The valve assembly 120 is inserted through valve ring 106 until the shoulder 125 of the sleeve 124 nests within the seat 103 of the valve ring 106. Then the shoulder and seat are cemented together. The inflatable device 100 can then be inflated simply by slidably pulling out valve stem 128 from its closed position on the valve ring seat 103. The valve assembly 120 may alternatively be opened by pushing out the valve stem 128 from within the thin elastic wall of the inflatable device 100. Obviously, other methods of extending the valve stem 128 may be employed.

Once valve assembly 120 is opened, openings 127 are exposed so that air can be blown into the ball through the valve stem 128. When the ball reaches the desired inflation and size , valve stem 128 is slidably returned to its closed position by pushing it back through sleeve 124. Thus the openings 127 are blocked by the sleeve 124 and the air passage between the inside and outside of the ball is closed. The closed top of valve stem 128 in its closed position is then substantially flush with the exterior surface of valve ring 106. The open end 123 of the valve stem 128 may also include flexible legs 130 each of which has a ledge or foot portion 132. The ledge 132 stops on the underside of the valve ring seat 103 to retain the valve stem 128 in its open position. The legs 130 may be depressed for inserting the stem 128 in the sleeve 124.

The inflatable device or game ball which results from this method and is preferred for use with this game assembly is a round ball made of high quality latex. The ball is relatively light, typically not much more than the weight of a balloon, and has a valve assembly 120 according to the above description by which the ball can be inflated by manual means such as blowing air through one's mouth. A lightweight ball is preferred because it will accelerate quickly when hit, but decelerate quickly due to air resistance.

It will also be understood, of course, that while the form of the invention herein shown and described constitutes a preferred embodiment of the invention, it is not intended to illustrate all possible forms thereof. It will also be understood that the words used are words of description rather than limitation and various changes may be made without departing from the spirit and scope of the invention disclosed.

I claim:

1. Apparatus for hand ball players to engage each other by propelling an inflated object ball back and forth across a barrier comprising:

a pair of spaced apart standards;

a deck extending between said standards and having a lateral dimension complementary to the distance between said spaced apart standards, and means to bias said standards laterally away from each other, and means to releasably connect said deck to said standards while overcoming the bias to maintain said standards upright, said means to releasably connect said deck yielding to said bias upon a predetermined impact with said deck to cause said deck to release from said standards so that said standards may be biased laterally away from each other;

said deck having a sufficient longitudinal dimension to form a horizontal plane separating said players, said plane forming said barrier being sufficiently imperforate to intercept any object ball seeking to penetrate said barrier.

2. The apparatus of claim 1 further comprising a support member positioned below said deck and extending between said standards sufficiently to support said standards generally upright.

3. The apparatus of claim 2 wherein said support member is removable from its support position and connectable to one of said standards within the plane thereof for storage.

4. The apparatus of claim 2 including means to releasably connect said support member to said standards.

5. The apparatus of claim 1 further comprising extender members removably affixed atop said standards for increasing the effective height of said standards.

6. The apparatus of claim 1 wherein said horizontal plane comprises a sheet of nylon.

7. The apparatus of claim 1 including means for adjusting the space between said standards according to the number and/or skill of said players.

8. The apparatus of claim 1 wherein one of said standards is formed with a generally V-shaped segment adaptable for measuring the size of an object ball.

9. The apparatus of claim 1 wherein said plane forming said barrier comprises a thin sheet of material.

10. A storage assembly for a hand ball apparatus comprising:

a pair of spaced apart planar standards, each standard including fastening means for supporting an extender;

a support member extending between said standards in a normal support position sufficiently to support said standards generally upright;

means for containing said planar standards in a side-by-side stacked relationship; and said support member being removable from its normal position and connectable to one of said standards with said fastening means within the plane of said one standard when said one standard is in said stacked relationship, whereby to make the storage assembly compact.

11. A method of storing a pair of standards and a standard support member of an apparatus for hand ball players which includes an extender for said standards comprising the steps of:

providing one of said standards with fastening means for supporting said extender;

removing said support member from said pair of standards; and securing said support member with said fastening means in the plane of one of said standards.

12. Apparatus for hand ball players to engage each other by propelling an inflated object ball back and forth across a barrier comprising:

a pair of spaced apart standards;

a deck extending between said standards and having a lateral dimension complimentary to the distance between said spaced apart standards, and means to bias said standards laterally away from each other, and means to releasably connect said deck to said standards while overcoming the bias to maintain said standards upright, said means to releasably connect said deck yielding to said bias upon a predetermined impact with said deck to cause said deck to release from said standards so that said standards may be biased laterally away from each other;

said deck having a sufficient longitudinal dimension to form a horizontal plane separating said players, said plane forming said barrier being made of a netting-like material sufficiently imperforate to intercept any object ball seeking to penetrate said barrier.

* * * * *